US005749240A

United States Patent [19]

McGill

[11] Patent Number: 5,749,240

[45] Date of Patent: May 12, 1998

[54] FROZEN PRODUCT STORAGE AND DISPENSING APPARATUS

[75] Inventor: Shane Robert McGill, Rochester, England

[73] Assignee: McGill Technology Limited, England

[21] Appl. No.: 669,905

[22] Filed: Jun. 25, 1996

[30] Foreign Application Priority Data

Mar. 14, 1996 [GB] United Kingdom ..... 9605378

[51] Int. Cl.[6] ..... A47F 3/04

[52] U.S. Cl. ..... 62/250; 62/440; 62/344; 221/197; 221/200

[58] Field of Search ..... 62/440, 441, 344, 62/250, 265; 312/45, 42, 72, 292, 327, 328; 221/197, 200

[56] References Cited

U.S. PATENT DOCUMENTS 2,671,001 3/1954 Ossanna, Jr. ..... 62/250

2,880,904 4/1959 Linthicum ..... 221/197

FOREIGN PATENT DOCUMENTS 3-278293 12/1991 Japan ..... 221/197

5-174239 7/1993 Japan ..... 221/197

*Primary Examiner*—John M. Sollecito

*Attorney, Agent, or Firm*—Gifford, Krass, Groh, Sprinkle, Patmore, Anderson & Citkowski, P.C.

[57] ABSTRACT

Refrigerated storage apparatus is primarily intended for storing product which can be removed without significant loss of cold air and is suitable for vertical, upright cabinets. The apparatus has a main access door extending vertically and moveable about a vertical axis. Access openings are provided, usually in the door to gain access to products within the storage compartment, the openings being of relatively small size. The compartment houses storage means for product and there may be storage means for each kind of product. Closure means seal off each access opening.

13 Claims, 1 Drawing Sheet

FROZEN PRODUCT STORAGE AND DISPENSING APPARATUS

This invention relates to refrigerated storage apparatus in particular for food products to be kept at a low temperature.

Refrigerated storage apparatus, such as refrigerators and freezers, have been provided which have a door through which access is gained into the storage compartment. Where the door is mounted about vertical hinges this arrangement spills cold air from the compartment every time the door is opened. This is a particular problem when the storage compartment is to be kept at low temperatures, such as −10° C., since colder air is spilled from the compartment. If smaller doors are provided this provides problems in accessing the contents of the apparatus.

An object of the invention is to provide a refrigerated storage apparatus giving access to its contents but with reduced spillage of cold air.

According to the invention refrigerated storage apparatus comprises a compartment for refrigerated product, a main access door permitting full access into the compartment, at least one access opening of a smaller size than the main access door, said access opening having closable access means, and storage means within the compartment for said product having feed means whereby product is fed towards said access opening.

Preferably the storage means includes feed means by which product is fed under gravity towards the access openings.

Conveniently two or more access openings are provided whereby an access opening is located adjacent storage means whereby different access openings provide an outlet for different product.

Usually the access openings will be provided in the main access door and the main access door is opened to refill the storage apparatus with product. Usually the main access door is kept closed to retain cold air within the storage compartment.

The storage means is conveniently in the form of an open construction whereby air may be circulated within the storage compartment. The base of the or each storage means may be inclined downwards towards the associated access opening whereby product is fed under gravity towards said access opening. Moreover the storage means may be moveable towards a position in which product may be loaded into the storage means after the main door has been opened, or otherwise. Such movement may be by a pivoting action about a hinge towards the lower end of the storage means. Alternatively the storage means may be slidably mounted on horizontal slides within the compartment.

To ensure that the product descends in the storage means towards the access opening, especially under conditions where the product may be frozen, there may be provided vibratory means whereby vibration is imparted to the storage means to loosen the product.

The main door may be on one side of the apparatus openable about vertical hinges. The access openings may be located within the door or on another side of the apparatus which is conveniently of generally rectangular upright construction.

The base of the apparatus may house refrigeration equipment.

There may be a row of storage means arranged side by side across the apparatus, each storage means containing a different product. Similarly there may be vertically spaced storage means each with access openings spaced one above the other. An access opening may give access to any one of a horizontal row of storage means or an individual access opening may be provided for each different product in a row.

Conveniently the access openings may be hinged closure members whereby upon pivoting the closure members about the hinge access is gained to the product. Alternatively the closure means for the access openings may be slidable. In each case the closure members provide a thermal seal when in their closed position and occupy a relatively small area of the apparatus to minimise leakage of cold air from the apparatus.

The apparatus may be required to warm up or temper product placed therein. Thus product may be placed in the apparatus at a temperature of, say, −20° C. and the temperature of the product is raised to a higher temperature of, say, −12° C. For this purpose heating means may be provided within the storage container to ensure that the product warms up at the required rate to the higher temperature.

Other features of the invention will appear from the following description of the embodiment of the invention given by way of example only and with reference to the drawing, in which.

Figure 1:
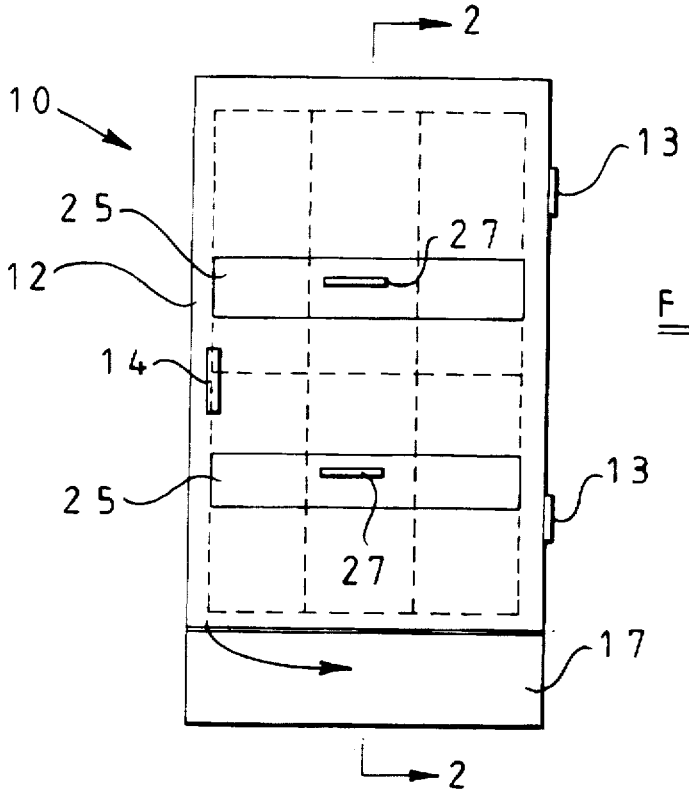
FIG. 1 is a front elevation
Figure 2:
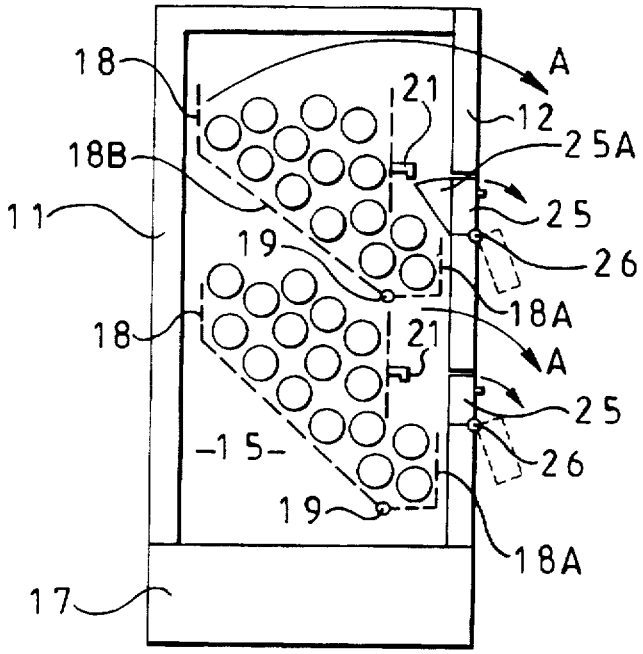
FIG. 2 is a vertical section on the line 22 of FIG. 1

Referring to the drawings there is shown refrigerated storage apparatus which is particularly intended to store frozen food product in individual containers. Access to the food product for the dispensing of product is provided.

The storage apparatus generally consists of a storage cabinet 10 of generally rectangular, upright shape. The body of the cabinet has insulated walls 11 and one wall of the cabinet is in the form of a main door 12 hingedly mounted about vertical hinges 13 and having a handle 14. The door 12 occupies one side of the storage compartment area 15 to give ready access into the interior of the compartment 15. In the base of the apparatus as at 17 is housed refrigeration and control equipment for maintaining the desired temperature within the compartment 15.

The compartment 15 houses storage means for product in the form of baskets 18 which are of open construction to allow the circulation of air within the compartment 15. In the illustrated arrangement there are vertically spaced horizontal rows of baskets 18, there being three baskets in each of two horizontal rows. This enables six different products to be contained within the compartment 15, each in their respective baskets. The baskets 18 are arranged for gravity feed of product within the or each basket towards a discharge or receiving portion 18A by providing an inclined portion 18B forming the base of each basket 18.

The baskets are arranged to be moved towards a filling position from that shown and in the illustrated arrangement each basket is pivotable about a hinge 19 in the directions A. After pivoting of the baskets towards their filling position the upper ends of the baskets are exposed to permit product to be loaded in.

As an alternative, not shown, the baskets 18 may be mounted on horizontal slides for movements to filling position. The baskets 18 are each provided with a handle 21 by which the baskets are moved to their filling position.

Removal of product from the discharge position 18A of a basket permits fresh product to move down the inclined surface 18B so that there is always product which is accessible. If necessary, especially if the product becomes frozen and attached to other product, there may be provided vibration means associated with the baskets 18 for vibrating the product and causing, the product to be more readily fed under gravity to the dispensing position. The baskets 18 can also be shaken for the same purpose using the handle 21.

In the illustrated arrangement the door 12 is provided with access openings fitted with closure members 25. As shown the closure members 25 are hinged about their lower edge at 26 using handles 27. As shown there is one closure member 25 for each horizontal row of baskets 18 but, if necessary, there may be a closure member 25 for each basket in each row. In this way only one closure member 25 needs to be opened in order to gain access to the contents of a basket.

Around the closure members 25 is formed a seal to prevent loss of air from within the compartment 15 when the closure member is closed. As a further aid to preventing undue loss of air the ends of the closure members 25 may be provided with end pieces or gussets, as at 25A to prevent loss of air from around the ends of the closure members when they are in the open position. It will be seen that when the closure members are lowered to the open position there is access to product in the dispensing region 18A of the baskets 18.

Instead of the access openings and the closure members 25 being formed on the door 12 the door 12 may be at one side of the apparatus with the access openings and associated closures 25 being at the opposite side. In this way the compartment 15 may be filled with product from one side whilst the apparatus remains in operation for dispensing product from the other side.

In use of the apparatus there may be provided, in addition to refrigerating means for maintaining a low temperature in the compartment, a heater may be provided whereby product within the container may be heated up from a relatively low temperature to a higher temperature. By this means the product may be tempered or heated up from say −20° C. to say −12° C. A thermostat can be arranged to switch on the heater at say −13° C. or lower and to switch off at say −11° C.

Instead of the hinged closure members 25, as shown in the drawing, the closure members may be formed as sliding closures moveable between positions open and closed.

It will be seen that the apparatus of the invention provides means whereby product within a refrigerated compartment may be removed without significant loss of cold air from within the compartment whilst still allowing full access to the compartment for refilling purposes. Moreover the apparatus may be arranged to provide access to individual different products within the container through their own access openings. This is a particular requirement of some food products such as ice cream which is kept at a particularly low temperature thereby avoiding significant loss of cold from within the apparatus.

I claim:

1. Refrigerated storage apparatus for storing containers of frozen food product which comprises:

a refrigerated compartment for, storing said containers at below freezing temperatures, a main access door permitting full access into the compartment, at least one access opening of a smaller size than the main access door, said access opening permitting access of individual containers from the compartment, closeable access means over said access opening, and storage means for said containers associated with said access opening said storage means being of open construction in the form of basket means to allow circulation of air around the containers and the storage means having a base inclined to the horizontal whereby containers are fed towards said access opening under gravity, the containers being randomly located within the storage means, and means for separating said frozen food product, frozen together, and facilitating feeding of the product towards the opening.

2. Refrigerated storage apparatus according to claim 1 wherein the main access door is located vertically to constitute a vertical side wall of the compartment and is openable about a vertical axis.

3. Refrigerated storage apparatus according to claim 1 wherein two or more access openings are provided and each opening is associated with storage means whereby a different product may be accessed at a different opening.

4. Refrigerated storage apparatus according to claim 1 wherein said access opening is formed in said access door, the access door being provided to load said product into the compartment.

5. Refrigerated storage apparatus according to claim 1 wherein said storage means is moveable relative to the compartment when the access door is open to place the storage means in a position to receive said product.

6. Refrigerated storage apparatus according to claim 5 wherein the storage means is pivotable and provides an upper opening for receiving product therein, pivoting of the storage means presenting the opening in a position for receiving product into the storage means.

7. Refrigerated storage apparatus according to claim 1 comprising vibration means whereby the storage means may be vibrated to vibrate product in the storage means and assist in movement of the product towards the access opening.

8. Refrigerated storage apparatus according to claim 1 comprising a plurality of storage means arranged side by side within the compartment and arranged to enable a different product to be contained within each storage means, product in each storage means being accessible through an access opening.

9. Refrigerated storage apparatus according to claim 1 comprising a plurality of storage means arranged vertically spaced from one another within the compartment, product from each storage means being accessible through an access opening.

10. Refrigerated storage apparatus according to claim 8 wherein an access opening is provided for each storage means.

11. Refrigerated storage apparatus according to claim 8 wherein an access opening gives access to two or more storage means.

12. Refrigerated storage apparatus according to claim 1 wherein each access opening is provided with a closure member movable to an opened position to gain access to product in the compartment, movement of the closure member being a pivotable movement or a sliding movement, and each access opening occupying a relatively small area of a side wall of the compartment.

13. Refrigerated storage apparatus according to claim 1 comprising means for warming up product placed in the compartment to a temperature above that at which the product is admitted but below 0° C.

* * * * *

UNITED STATES PATENT AND TRADEMARK OFFICE

CERTIFICATE OF CORRECTION

PATENT NO. : 5,749,240

DATED : May 12, 1998

INVENTOR(S) : Shane Robert McGill

It is certified that error appears in the above-identified patent and that said Letters Patent is hereby corrected as shown below:

Column 2, line 56, change "movements" to --movement--.
Column 2, line 56, before "filling" insert --a--.
Column 4, line 55, delete "or a sliding movement--.

Signed and Sealed this

Fifth Day of January, 1999

*Attest:*

*Attesting Officer*

*Acting Commissioner of Patents and Trademarks*